United States Patent [19]

Johansson

[11] 4,120,368

[45] Oct. 17, 1978

[54] SUPPLYING MOTIVE FLUID TO BELOW GROUND TOOL DRIVE FROM A PRESSURIZED BORE HOLE

[76] Inventor: Sven Halvor Johansson, Saab Scania Aktiebolag, Linkoping, Sweden, S 581 88

[21] Appl. No.: 848,219

[22] Filed: Nov. 3, 1977

[30] Foreign Application Priority Data

Nov. 5, 1976 [SE] Sweden ..... 7612371

[51] Int. Cl.[2] ..... E21B 1/08; E21B 3/12

[52] U.S. Cl. ..... 175/71; 175/94; 175/99; 299/31

[58] Field of Search ..... 175/71, 94, 95, 97–100; 299/31

[56] References Cited

U.S. PATENT DOCUMENTS

| | | | |
|---|---|---|---|
| 2,946,578 | 7/1960 | De Smaele | 176/76 X |
| 3,061,287 | 10/1962 | Robbins | 175/94 X |
| 3,180,436 | 4/1965 | Kellner et al. | 175/94 X |
| 3,185,225 | 5/1965 | Ginies | 175/98 X |
| 3,493,165 | 2/1970 | Schonfeld | 175/94 X |
| 3,942,595 | 3/1976 | Suonishnikov et al. | 175/99 |

*Primary Examiner*—Ernest R. Purser
*Assistant Examiner*—Nick A. Nichols, Jr.
*Attorney, Agent, or Firm*—Ira Milton Jones

[57] ABSTRACT

A bore hole to be deepened far into air-impermeable bedrock has an air-tight lining and an air lock in its upper portion, and it is pressurized below the air lock. A duct comprising endwise connected but disconnectable duct sections extends through the bore hole, its top end open to the atmosphere. A drilling mechanism having a telescoping connection with the bottom of the duct comprises a bit driven by a pneumatic motor that has an exhaust air outlet opening into the duct and a pressure air inlet in the bore hole outside the duct. At intervals along the duct remotely controllable supporting and moving devices are fixed to duct sections, each device having a pneumatic actuator with an inlet opening to the bore hole and an outlet opening to the duct. The devices have gripping elements that frictionally engage the bore hole surface to confine the duct against motion or to move it up or down for raising or lowering the drilling mechanism. Boring waste is sucked into the duct and blown up to the surface by exhaust air from the motor and actuators.

9 Claims, 1 Drawing Figure

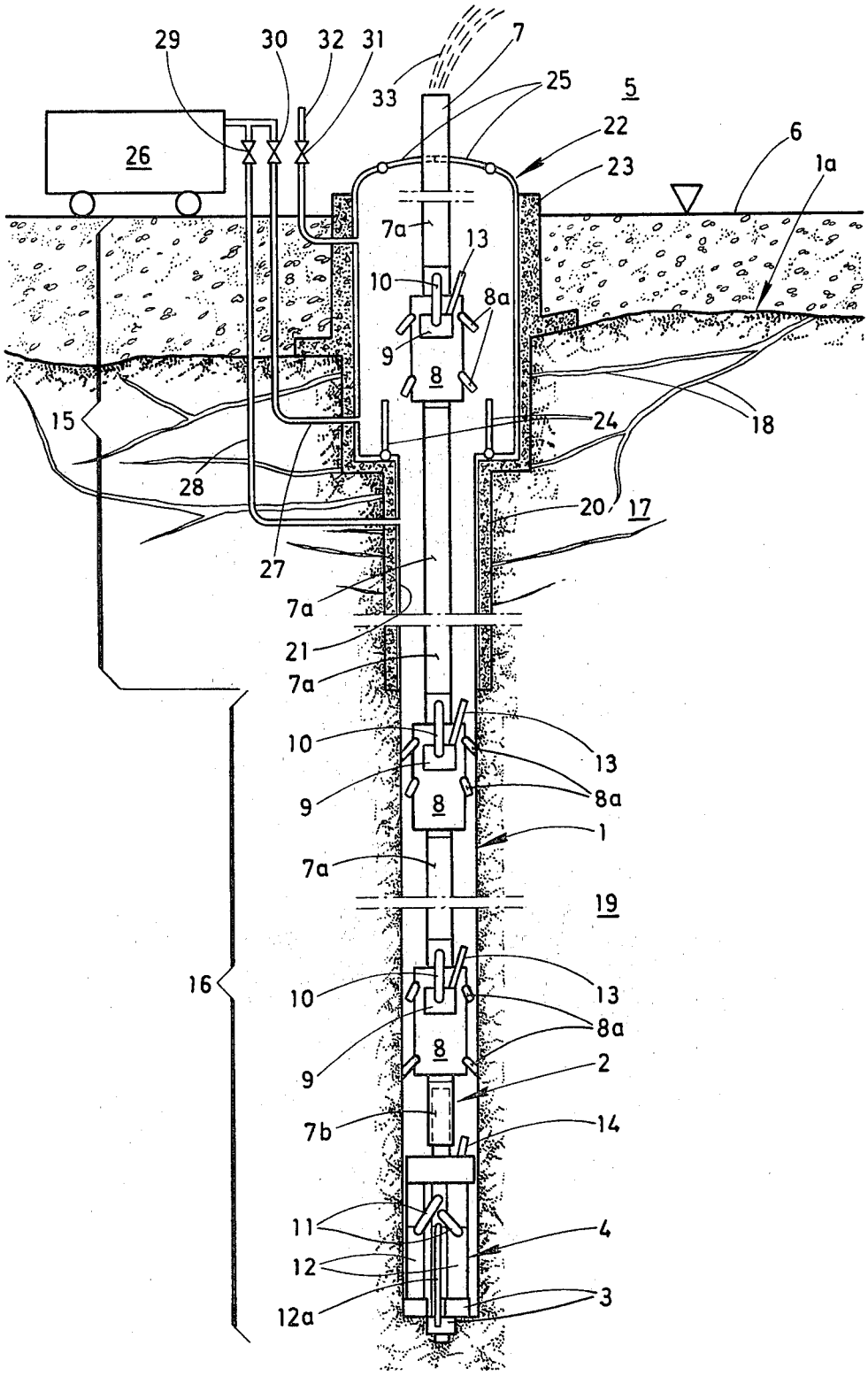
29
30
32
31
33
7
25
5
22
6
1a
23
26
7a
13
10
8a
9
8
15
24
18
28
20
17
27
7a
21
7a
10
13
9
8a
8
1
7a
19
16
10
13
8a
9
8
2
7b
14
11
4
12
12a
3

SUPPLYING MOTIVE FLUID TO BELOW GROUND TOOL DRIVE FROM A PRESSURIZED BORE HOLE

This invention relates to apparatus for drilling very deep bore holes into the earth, and is more particularly concerned with means for supplying pressure fluid to the fluid motor of a drilling mechanism operating at the bottom of an extremely deep bore hole, and cooperating means for readily raising and lowering the drilling mechanism for such purposes as changing of its drill bit. The subject matter of this application is closely related to that of the applicant's copending application, Ser. No. 848,220, filed Nov. 3, 1977.

In known apparatus for drilling deep bore holes into the earth, drilling mechanism comprising a drill bit and a pressure fluid motor that directly drives the drill bit is wholly located at the bottom of the bore hole being drilled, and pressurized fluid is fed to the motor through a tubular shaft or duct that is supported from the surface of the earth at the mouth of the bore hole. When the drill bit has become worn and has to be replaced, the drilling mechanism is pulled up from the bottom of the bore hole by means of the tubular shaft or duct.

With such apparatus, the depth of the bore hole that can be drilled is limited by the fact that the shaft or duct tends to be broken by its own weight when it exceeds a certain length. The shaft length at which this occurs can be designated the breaking length and is defined by the relationship:

$$L_s = T/p$$

where $L_s$ is the breaking length, T is the tensile strength of the material of the shaft, and $p$ is the density of the material. For a shaft or duct of good steel construction, the breaking length is slightly over 6,000 meters.

German Pat. No. 96,092 of 1898 disclosed apparatus wherein a pneumatic motor that was drivingly coupled to a drill bit was supported at the bottom of the bore hole by an exhaust air duct that extended upwardly in the bore hole. Pressure air from a source thereof near the mouth of the bore hole was conducted down to the motor through a smaller pressure duct that extended downwardly along the exterior of the exhaust air duct, and exhaust air from the motor, flowing up and out of the exhaust air duct, carried with it debris loosened by the drill bit. Although this arrangement differed from the more conventional one in the provision of two ducts that extended through the bore hole alongside one another, instead of only one duct or shaft, the two ducts together obviously had the same breaking length limitation that either would have had alone, and the apparatus of the German patent therefore could not drill a bore hole of any greater depth than other apparatus heretofore known.

U.S. Pat. Nos. 2,946,578; 3,185,225 and 3,827,512 disclosed various types of rock boring apparatus wherein, in each case, a remotely controllable device directly coupled with a drilling mechanism served to move the drilling mechanism along the bore hole or to restrain it against such motion. In each of these, the moving and restraining device had gripping elements for engaging the circumferential surface of the bore hole and had a remotely controllable fluid motor for actuating the gripping elements. When the gripping elements were maintained stationary and engaged with the bore hole surface, they prevented motion of the device and the drilling mechanism; and when they were actuated for motion, the gripping elements engaged the bore hole surface with a crawling or climbing action that caused the drilling mechanism to progress along the bore hole. Pressure fluid was conducted to the fluid motors of the drilling mechanism and of the moving and restraining device by means of a hose or duct that extended along the bore hole from a pressure fluid source at its mouth. Such devices were suitable for drilling relatively short bore holes; but in deep drilling the moving and restraining device could not be employed for moving the drilling mechanism between the top and the bottom of the bore hole, owing to the need for maintaining a connection between the device and a pressure fluid source as the device moved up and down, and therefore some other means had to be used for this purpose, as for example a cable.

Apparatus for drilling bore holes to depths substantially greater than the breaking length of a shaft or duct supported from the surface of the earth can make available geothermal energy that can be found at great depths in non-volcanic areas. A closed duct system can be installed in a bore hole drilled deep into the crystalline and homogeneous primary rock formation, to enable water or a similar fluid heat transfer medium to be circulated down to the bottom of the bore hole for abstracting heat energy from the rock formation and back up to the surface for utilization of the heat energy. For this purpose, however, the bore hole must be drilled to a heretofore unprecedented depth, since the estimated temperature rise in such bedrock is about 30° C/km. Bore hole depths considered suitable for geothermal energy purposes are therefore in excess of 10,000 meters, or about twice the breaking length of a hanging rod or shaft.

The present invention solves the problem of providing apparatus capable of drilling to great depths in the earth, to thus make possible utilization of geothermal energy from deep in the primary rock formation.

Hence, the general object of the invention is to provide apparatus for deepening bore holes to depths greatly beyond what has heretofore been possible, which apparatus comprises a drilling mechanism consisting of a drill bit directly coupled to a pneumatic motor, means for moving the drilling mechanism up and down in the bore hole without reliance upon a shaft, tube or cable that extends down the bore hole and supports the drilling mechanism from the surface of the earth, and means for supplying pressure air to the pneumatic motor without the need for making frequent disconnections and reconnections of a pressure air hose or duct as the drilling mechanism moves down with deepening of the bore hole and is moved up and down in the bore hole in connection with changing of a worn drill bit.

It is also an object of the present invention to provide apparatus for drilling extremely deep bore holes that provides for substantially constant removal of boring debris from the bottom of the bore hole as drilling progresses.

In general, the objects of the invention are achieved with a drilling mechanism for deepening a bore hole, comprising a drill bit directly coupled to a pneumatic motor that has an inlet for pressurized air and an outlet for exhaust air, and, in cooperation with that drilling mechanism, apparatus comprising duct means extending substantially all along the bore hole to have its upper end open to the atmosphere at the surface, said duct means comprising endwise connected duct sections, and the air outlet of the pneumatic motor being communicated with the interior of the duct means; means for maintaining pressurized air in at least the lower portion of the bore hole, externally of the duct means, so that such air can flow into the air inlet of the pneumatic motor; at least one supporting and moving device having connections with the bottom portion of the duct means and with the drilling mechanism and having gripping elements which are engageable with the side surface of the bore hole and which can be activated by a remotely controllable fluid pressure actuator, for supporting the duct means against motion along the bore hole or for effecting motion of the duct means, along with the drilling mechanism, either upwardly or downwardly in the bore hole, the pneumatic actuator of said device also having an air inlet which opens to the bore hole externally of the duct means and an air outlet communicated with the interior of the duct means. In a very deep bore hole, similar supporting and moving devices are connected with each of a plurality of duct sections along the length of the bore hole, so that all of the devices cooperate in supporting the duct means and in moving it up and down. The objective of removing drilling debris from the bottom of the bore hole is accomplished by means of a suction tube having an inlet near the drill bit and an outlet opening to the interior of the duct means. The bore hole is sealed for pressurization by means of an air lock in its upper portion, through which the duct means can slidingly pass, and is pressurized from a pressure air source at the surface by means of ducts that lead to the air lock and to a location in the bore hole that is beneath the air lock.

With these observations and objectives in mind, the manner in which the invention achives its purpose will be appreciated from the following description and the accompanying drawing, which exemplify the invention, it being understood that changes may be made in the specific apparatus disclosed herein without departing from the essentials of the invention set forth in the appended claims.

The accompanying drawing illustrates one complete example of an embodiment of the invention constructed according to the best mode so far devised for the practical application of the principles thereof, and in which:

The single FIGURE is a view in vertical section through a substantially deep bore hole that is being further deepened by means of apparatus embodying the present invention.

Referring now to the accompanying drawing, the numeral 1 designates a deep, vertically extending bore hole of circular cross section that has been drilled through outer layers of rock and a substantial distance down into the primary formation or bedrock 1*a*. Drilling is accomplished by means of a drilling mechanism 4 that works at the bottom of the bore hole and comprises a pneumatic motor 12 which is directly coupled to four cooperating drill bits 3. Details of the drilling mechanism 4 are not illustrated, inasmuch as it is generally of known construction.

Steel duct means 7 extends upwardly through the bore hole 1 from the drilling mechanism 4 and has its upper end open to the atmosphere 5 at a level near the surface 6, preferably somewhat above the surface. As will appear in more detail as the description proceeds, the duct 7 is a return or exhaust air duct and also serves to conduct up to the surface 6 borings or debris loosened by the drill bits 3.

The duct means 7 is made up of endwise connected individual steel duct sections 7*a*, which are preferably substantially identical and of uniform length. Details of the connections between duct sections 7*a* are not illustrated, because various suitable connection arrangements are known. However, it should be observed that the connections between duct sections 7*a* are such as to provide the duct 7 with a uniform outside diameter all along its length, and that the connections are airtight and are of such character that individual duct sections can be readily connected to the top of the duct means or disconnected therefrom.

Certain duct sections, located at regular intervals along the duct means 7, are connected with supporting and moving devices 8. Details of such a device are disclosed in Swedish application 7612372-8, and therefore the devices 8 are shown only more or less diagrammatically in the accompanying drawing. In general, each of the supporting and moving devices 8 is equipped with a number of gripping elements 8a which can frictionally engage the side surface of the bore hole and which are actuated by a remotely controllable pneumatic actuator 9. When the gripping elements 8a of a device 8 are extended and stationary, they engage the bore hole surface to confine the device 8 and its connected duct section against motion relative to the bore hole. Distinctive signals — which can be sound signals transmitted along the duct means 7 — adjust pneumatic valves (not shown) to cause the pneumatic actuator 9 of every device 8 in the bore hole to so actuate its gripping elements 8a that they engage the bore hole surface with a creeping or climbing motion. In this manner the several devices 8, operating in unison, carry the duct means 7 either upwardly along the bore hole or downwardly along it, depending upon the signification of the particular signal being transmitted. It will be understood that the pneumatic motor 12 of the drilling mechanism 4 is similarly controlled for starting and stopping.

As explained in more detail hereinafter, pressurized air is fed to the pneumatic motor 12 of the drilling mechanism 4 and to the pneumatic actuators 9 for the several devices 8 by pressurizing the bore hole itself, externally of the duct means 7. Hence pressure air is fed to the pneumatic drilling motor 12 through an inlet 14 that simply opens to the interior of the bore hole, externally of the duct 7; and each of the pneumatic actuators 9 has an air inlet 13 that similarly opens to the bore hole. Although not shown, it will be understood that suitable air filters and shielding structure are provided for the air inlets 13 and 14, to keep dust and dirt out of the pneumatic mechanisms. and to protect the inlets from falling stones and the like. The exhaust air outlet 11 of the pneumatic motor 12 and the exhaust air outlets 10 of the several pneumatic actuators 9 are communicated with the interior of the duct means 7.

From the description to this point, it is apparent that the duct 7, whether stationary in the bore hole or being moved upwardly or downwardly along it, is supported at intervals along its length by the supporting and moving devices 8 in their cooperation with the bore hole surface, and consequently there is no unsupported length of the duct means that is stressed to anywhere near the breaking point by its own unsupported weight.

There is a telescoping connection 7*b* between the lower end of the duct means 7 and the drilling mechanism 4 that permits the drilling mechanism to move up and down between defined limits relative to the duct means. Thus, as drilling proceeds with the duct means 7 maintained in a fixed position along the bore hole, the drilling mechanism 4 works its way down to a position at which the telescoping connection 7*a* is fully extended. The actuators 9 of the devices 8 are then put into operation to lower the duct means sufficiently for the telescoping connection 7*b* to be fully contracted. Drilling thus continues in stages defined by the extent to which the telescoping connection 7*b* can extend and contract.

If the drilling mechanism 4 is to be withdrawn from the bore hole, as for change of drill bits, the devices 8 are caused to operate in such a manner that they raise the duct 7 along the length of the bore hole, and the drilling mechanism 4 is drawn up with the duct 7 through the telescoping connection 7*b*. For lowering the drilling mechanism 4 into the bore hole, the process is reversed, so that the devices 8 control downward motion of the duct 7 with the drilling mechanism connected to its lower end.

It will be understood that during raising of the duct means 7, individual duct sections 7*a* are disconnected from its upper end as the lower end of each duct section rises to a level about the surface. As the drilling mechanism is lowered into the bore hole, individual duct sections 7*a* are connected to the top of the duct means 7 to maintain its upper end at a level above the surface, and of course duct sections comprising the devices 8 are added to the duct 7 at regular intervals as it moves down.

The bore hole 1 has an upper portion 15, which extends through overlying rock formations 17, and a lower portion 16 that is wholly within dense, homogeneous bedrock 19. The rock formations 17 through which the upper bore hole portion 15 extends, which include the upper portion of the primary rock formation 1a, may be porous and often have water filled fissures 18; but the rock in which the lower bore hole portion 16 is drilled is dense, homogeneous and is practically air-tight because of the great pressure which the overlying rock imposes upon it. The upper bore hole portion 15, which comprises about the first 2,000 meters of depth and extends a small distance down into the homogeneous rock formation 19, is drilled with a slightly larger diameter than the lower portion 16, but it has an air-tight lining with an inside diameter equal to the diameter of the lower portion 16 of the bore hole, which lining can be built up in a known manner from steel-plate tubular members 21 surrounded by a cast concrete ring 20. A drilling mechanism and procedure generally as described in the above mentioned German patent are suitable for drilling the larger diameter upper portion 15 of the bore hole.

When the lower portion 16 of the bore hole is to be drilled down to substantial depths, the mouth of the bore hole is provided with a sealing closure that is preferably in the form of an air lock 22 of known type. An uppermost portion of the bore hole, having a substantially enlarged diameter, is lined with steel plate backed by reinforced concrete 23 to provide an air lock chamber. A set of air lock doors 24 at the bottom of the air lock chamber can be closed to provide an air-tight seal between the air lock chamber and the rest of the bore hole beneath it. A second set of air lock doors 25, at the top of the air lock chamber, can be closed to seal that chamber from the atmosphere 5. Each set of air lock doors 24, 25 can be opened and closed independently of the other, as by means of fluid pressure cylinder actuators (not shown), and each set of doors, when closed, has a sealed engagement with the duct 7 such that the duct can slide up and down through the doors. When open, each set of doors can be readily passed by the drilling mechanism 4 or any of the devices 8.

Air in the bore hole beneath the air lock is maintained at a high pressure by means of a compressed air source 26 at the surface, here indicated as an air compressor or air pump. From the source 26, a duct 28, in which there is a shut-off valve 29, leads to the bore hole at a location therein just below the lower air lock doors 24. For pressurizing the air lock chamber, a second duct 27, having a shut-off valve 30, leads to that chamber from the source 26. A duct 32, in which there is a shut-off valve 31, leads from the air lock chamber to the atmosphere to provide for depressurizing the air lock chamber.

When the duct 7 is being lowered into the bore hole, the upper air lock doors 25 are opened when it is necessary to admit the drilling mechanism 4 and each of the devices 8 into the air lock chamber. Before the upper doors 25 are opened, the air lock chamber is of course depressurized by opening the outlet valve 31 in the depressurizing duct 32; and whenever the upper doors 25 are open, the lower set of air lock doors remain closed, so that air pressure is maintained in the bore hole. When the drilling mechanism 4 or a device 8 is entirely within the air lock chamber, the upper doors 25 are closed, the chamber is pressurized by closing the outlet valve 31 and opening the valve 30 in the pressure duct 27, and, when pressure in the air lock chamber is equalized with pressure in the bore hole beneath it, the lower air lock doors 24 are opened to allow the drill mechanism 4 or the device 8 to pass downwardly out of the air lock chamber. During upward movement of the duct 7 the air lock procedure is of course reversed. Thus the air lock serves to prevent any substantial loss of pressure in the main part of the bore hole as the drilling mechanism 4 and the devices 8 pass into or out of the bore hole through the air lock.

The distance between the two sets of air lock doors 24, 25 is sufficient to enable the drilling mechanism 4 or a device 8 to pass upwardly or downwardly through the air lock chamber without stopping to wait for movement of the air lock doors. The importance of quickly and efficiently raising and lowering the drilling mechanism 4 is apparent from the fact that the drill bits 3 must be changed about thirty times in the course of drilling down to a 10,000 meter depth.

When the bore hole is pressurized, the interior of the duct means 7 constitutes, in effect, a vacuum source. Suction ducts 12*a* communicated with the interior of the duct 7, at its lower portion, have inlets near the drill bits 3 to suck away material loosened by the drill bits; and such material is carried up the duct means by the exhaust air from the pneumatic drill drive motor 12 and from the actuators 9 of the several supporting and moving devices 8. Such exhaust air and the material carried by its issues from the top of the duct 7, as indicated at 33, although preferably the air is passed through a cyclone separator (not shown) to clean it before it is released into the atmosphere. It will be understood that pressure in the bore hole is maintained at a substantially constant high value by the air compressor 26 and suitable control means cooperating with it, and the above described air lock structure prevents loss of such pressure when the drilling mechanism 4 and the devices 8 are moved into and out of the bore hole.

From the foregoing description taken with the accompanying drawing it will be apparent that this invention solves the problem of drilling bore holes into the earth to depths greatly in excess of 6,000 meters, and that the invention provides simple and efficient apparatus by which such deep drilling can be accomplished quickly and at low cost.

Those skilled in the art will appreciate that the invention can be embodied in forms other than as herein disclosed for purposes of illustration.

I claim:

1. Apparatus for substantially deepening a bore hole in the earth, comprising:

A. duct means comprising a plurality of endwise connectable and disconnectable duct sections, said duct means extending substantially the full length of the bore hole with a lower end portion of the duct means at the bottom of the bore hole and an upper end of the duct means opening to the atmosphere at the top of the bore hole;

B. a drilling mechanism comprising (1) a drill and (2) a pneumatic motor by which the drill is driven and which has (a) an outlet for exhaust air communicated with the interior of said duct means, at said lower end portion thereof, and (b) an inlet which is external to the duct means and into which air can flow from the bore hole;

C. a supporting and moving device having connections with the lower end portion of the duct means and with the drilling mechanism, said supporting and moving device (1) having movable gripping elements engageable with side surface portions of the bore hole to provide for holding the duct means in an axially fixed position and for raising and lowering the duct means and the drilling device, and (2) having a remotely controllable pneumatic actuator by which said gripping elements are actuated, said actuator having (a) an inlet which is external to the duct means and into which air can flow from the bore hole and (b) an outlet for exhaust air communicated with the interior of said duct means; and D. means for maintaining pressurized air in the bore hole, externally of said duct means, to provide a supply of pressurized air to the inlets of said motor and said actuator and to provide for expulsion of drilling debris from the bottom of the bore hole through said duct means.

2. The apparatus of claim 1, further characterized by: said means for maintaining pressurized air in the bore hole comprising:

(1) means sealing the surface of the bore hole, all around the same, in that portion of the bore hole which is above the level of air-impermeable bedrock;

(2) closure means for closing the bore hole near the mouth thereof, said closure means being arranged to have the duct means extend axially slidably therethrough; and (3) means communicating a source of pressurized air with the interior of the bore hole at a location therein that is below the closure means.

3. The apparatus of claim 1, further characterized by:

(1) said connection between the supporting and moving device and the duct means being a fixed connection between that device and a duct section at the bottom of the duct means; and (2) said connection between the supporting and moving device and the drilling mechanism comprising a telescoping connection between said duct section and the drilling mechanism, by which the drilling mechanism is permitted to move between defined limits in both axial directions relative to said duct section.

4. The apparatus of claim 3, further characterized by:

(3) further supporting and moving devices, one for each of at least certain of the duct sections above said duct section, each of said further supporting and moving devices being fixed to its duct section and being substantially identical with the first mentioned supporting and moving device.

5. The apparatus of claim 4, wherein that portion of the bore hole that is above the level of air-impermeable bedrock has its surface sealed, all around the same, to be air tight, further characterized by:

(1) two sets of sealing doors, one at the mouth of the hole and the other spaced therebeneath by a distance greater than the axial length of the longer of the drilling mechanism and a supporting and moving device, each of said sets of sealing doors being arranged (a) to be passed by said duct means with an axially slidable sealing fit and (b) to be openable and closeable independently of the other set of sealing doors, said sealing doors cooperating to define an air lock in the upper portion of the bore hole; and (2) means for pressurizing and depressurizing said air lock independently of air pressure in the portion of the bore hole beneath the air lock.

6. Apparatus for substantially deepening a bore hole in the earth by means of a drilling mechanism that comprises a drill bit and a pneumatic motor coupled to the drill bit in proximity thereto and having an air inlet and an air outlet, said apparatus being characterized by:

A. a duct extending from near the bottom of the bore hole to the mouth thereof to have its upper end communicated with the atmosphere, said duct comprising a plurality of endwise adjacent duct sections that have air-tight disconnectable connections with one another;

B. means for maintaining air under pressure in the bore hole externally of said duct;

C. said pneumatic motor having its air inlet opening to the bore hole externally of said duct and having its air outlet opening to the interior of said duct;

D. means providing a telescoping connection between the bottom of the duct and the drilling mechanism to provide for relative axial movement between defined limits between the duct and the drilling mechanism; and E. at least one supporting and moving device having a fixed connection with the duct and thus connected with the drilling mechanism through said telescoping connection, said supporting and moving device having (1) a remotely controllable pneumatic actuator with an air inlet in the bore hole, externally of the duct, and an air outlet communicated with the interior of the duct, and (2) a plurality of gripping elements engageable with the surface of the bore hole and actuated by the actuator to selectively and alternatively cooperate with the bore hole surface to (a) confine the duct against motion in the bore hole, (b) move the duct upwardly in the bore hole, or (c) control the duct in downward movement in the bore hole.

7. A method of deepening a substantially deep bore hole in the earth with the use of a drill driven by a pneumatic motor that has a pressure air inlet and an exhaust air outlet and a duct which extends upwardly through the bore hole from said motor, which method is characterized by:

A. communicating the interior of said duct with the atmosphere at the upper end of the duct;

B. sealing the upper end portion of the bore hole air tight all around said duct;

C. forcing air under pressure into the bore hole beneath the sealed upper end portion thereof, externally of said duct;

D. communicating the pressure air inlet of said motor with the bore hole externally of said duct;

E. directing exhaust air from the exhaust air outlet of said motor into the interior of said duct; and F. communicating the interior of said duct with a localized zone in the bottom of the bore hole that is external to the duct to thereby enable drilling debris to be forced into the duct and up through it to the surface by pressurized air from the bore hole.

8. The method of claim 7, further characterized by:

G. supporting said duct, at intervals along its length, by frictional engagement with portions of the side surface of the bore hole.

9. The method of claim 8 wherein the duct is supported at intervals along its length by means of remotely controllable supporting and moving devices that are fixed to the duct, each of which devices comprises a pnuematic actuator having a pressure air inlet and an exhaust air outlet, further characterized by:

H. communicating the pressure air inlet of the actuator for each said device with the bore hole externally of said duct; and I. directing exhaust air from the exhaust air outlet of the actuator for each said device into the interior of the duct.

* * * * *

UNITED STATES PATENT AND TRADEMARK OFFICE

CERTIFICATE OF CORRECTION

PATENT NO. : 4,120,368
DATED : October 17, 1978
INVENTOR(S) : Sven Halvor Johansson It is certified that error appears in the above-identified patent and that said Letters Patent are hereby corrected as shown below:

The inventor's address should be given as:

Enelund, Vardsberg, S-585 90
Linkoping, Sweden

Signed and Sealed this

*Twenty-fifth* Day of *March 1980*

[SEAL]

*Attest:*

SIDNEY A. DIAMOND

*Attesting Officer*

*Commissioner of Patents and Trademarks*